United States Patent [19]

Long

[11] Patent Number: 4,873,014

[45] Date of Patent: Oct. 10, 1989

[54] POLYAMINE-POLYGLYCOL INHIBITOR FOR STEEL PICKLING

[75] Inventor: Ray S. Long, Walnut Creek, Calif.

[73] Assignee: The Dow Chemical Company, Midland, Mich.

[21] Appl. No.: 149,022

[22] Filed: Jan. 27, 1988

[51] Int. Cl.[4] ..... C23F 11/04; C23F 11/14

[52] U.S. Cl. ..... 252/148; 252/146; 252/173; 252/174.21; 252/390

[58] Field of Search ..... 252/146, 148, 173, 174.21, 252/390

[56] References Cited

U.S. PATENT DOCUMENTS

| | | | |
|---|---|---|---|
| 2,649,415 | 8/1953 | Sundberg et al. | 252/148 |
| 3,211,667 | 10/1965 | Coyne et al. | 252/392 |
| 3,277,104 | 10/1966 | Riggs | 252/390 |
| 3,385,734 | 5/1968 | Barkley et al. | 252/148 |
| 3,458,453 | 7/1969 | Kautsky | 252/390 |
| 3,475,346 | 10/1969 | Teumae | 252/148 |
| 3,676,354 | 7/1972 | Kaneko et al. | 252/147 |
| 3,790,496 | 2/1974 | Hausler | 252/392 |
| 4,670,186 | 6/1987 | Quinlan | 252/392 |

*Primary Examiner*—Paul Lieberman
*Assistant Examiner*—Kathleen Markowski
*Attorney, Agent, or Firm*—Paula Sanders Ruhr

[57] ABSTRACT

The corrosion of steel during acid pickling is inhibited by the use of an acid pickling composition containing hydrochloric acid, water and a mixture of a polyalkylene polyamine and a polyglycol in an amount sufficient to inhibit corrosion. A 75:25 ratio of tetraethylene pentamine to polypropylene glycol is particularly effective as a corrosion inhibitor.

17 Claims, No Drawings

POLYAMINE-POLYGLYCOL INHIBITOR FOR STEEL PICKLING

BACKGROUND OF THE INVENTION

This invention relates to a process for inhibiting corrosion during acid pickling operations employed in the treatment of iron-containing metals, particularly steel.

During the processing of steel to form steel sheets, plates, tubes, nails, wire, and other articles, the steel is subjected to elevated temperatures which results in the formation of iron oxide. Before the steel can be subjected to further processing, such as electroplating, cold rolling and galvanizing, the iron oxide must be removed. This is typically done by immersing the sheets, plates, tubes, nails and so on in a suitable acid solution. Hydrochloric acid is frequently used in this application. In this process, typically called acid pickling or steel pickling, the acid solution attacks and dissolves the iron oxide. This process may be represented by the equation $$FeO+2HCl \rightarrow FeCl_2+H_2O.$$

Unfortunately, the acid solution will also attack the steel itself once the iron oxide layer is removed. This second reaction is represented by the equation $$Fe+2HCl \rightarrow FeCl_2+H_2.$$

This second reaction can lead to the loss of a substantial amount of steel during the pickling process. Approximately 0.5 percent of the steel processed may be dissolved which has a significant economic impact. When a typical plant might treat approximately a million tons of steel per year, the loss of even 0.5 percent of the steel treated would be the loss of 5000 tons of steel. At a price of three hundred dollars per ton, this loss could represent about 1.5 million dollars per year. For these reasons, it is desirable to use a corrosion inhibitor during the pickling of steel.

A desirable corrosion inhibitor is one which enhances the selectivity of the acid toward the surface impurities on the metal, decreases the selectivity of the acid toward the metal itself, is economical to use, and is environmentally safe. Various compositions have been identified as corrosion inhibitors. U.S. Pat. Nos. 3,607,781 and 3,676,354 describe a corrosion inhibitor comprising a surface-active agent, a hydroxyalkylamine and a combination of mineral acids. The use of a mixture of higher primary aliphatic and alicyclic amines with water-soluble, nonionic emulsifying agents as a corrosion inhibitor is disclosed in U.S. Pat. No. 2,649,415. Polyglycolamines have also been disclosed as corrosion inhibitors in U.S. Pat. No. 4,171,279. However, these compositions and others known in the art are often complex, sometimes environmentally objectionable, sometimes not effective under normal use conditions and frequently expensive. As a consequence, existing corrosion inhibitors do not meet the needs of many steel manufacturers. Thus, some steel manufacturers use no corrosion inhibitor at all.

What is needed is a corrosion inhibitor which is effective, simple, environmentally unobjectionable and relatively inexpensive.

SUMMARY OF THE INVENTION

In one aspect, this invention is an acid pickling composition including such a corrosion inhibitor. The acid pickling composition of this invention consists essentially of hydrochloric acid, water and a mixture containing from about 65 to about 95 weight percent of at least one polyalkylene polyamine and from about 5 to about 35 weight percent of at least one polyglycol, based on the total weight of polyalkylene polyamine and polyglycol present, wherein the mixture of amine and polyglycol inhibits the corrosion of iron-containing metals by the acid. It is surprising that the mixture of polyalkylene polyamine and polyglycol is more effective in inhibiting corrosion than a composition using polyalkylene polyamine or polyglycol alone.

In another aspect, this invention is a process for inhibiting the corrosion of iron-containing metals during acid pickling using an effective amount of the composition described above.

DETAILED DESCRIPTION OF THE INVENTION

Polyalkylene polyamines are useful in the practice of this invention. It is preferred that the polyalkylene polyamine correspond to the formula $$H_2N-(R-NH)_n-R-NH_2$$

wherein R may be ethylene or propylene and n is a number from 1 to about 165 such that the molecular weight of the polyalkylene polyamine is at least about 100 and is no greater than about 5000. It is more preferred that the molecular weight of the polyalkylene polyamine is no greater than about 2000.

Examples of polyalkylene polyamines useful in the practice of this invention include diethylene triamine, triethylene tetramine, tetraethylene pentamine, pentaethylene hexylamine, dipropylene triamine, tripropylene tetramine, and tetrapropylene pentamine. It is preferred to use tetraethylene pentamine as the polyalkylene polyamine in the inhibitor composition. The polyalkylene polyamines useful in the practice of this invention are well-known and are commercially available.

Polyglycols are also useful in the practice of this invention. For purposes of this invention, preferred polyglycols include polyethylene glycols and polypropylene glycols. Polyethylene glycols are the condensation polymers of ethylene glycol prepared by the condensation of ethylene glycol or of ethylene oxide and water. Similarly, polypropylene glycols are the condensation polymers of propylene glycol or of propylene oxide and water. The polyglycols useful in the practice of this invention correspond to the formulas $$HOCH_2(CH_2OCH_2)_nCH_2OH,$$

$$H(OCH_2CH_2)_nOH \text{ or}$$

$$HO(CH_2CH_2CH_2O)_nH.$$

It is preferred that the polyglycols useful in the practice of this invention have a molecular weight of at least about 200 and no more than about 5000. It is more preferred that the molecular weight be no greater than about 3000. It is preferred that the polyglycols have a molecular weight of at least about 1000 and more preferably at least about 2000. The polyglycols useful in the practice of this invention are available commercially or may be prepared by methods well-known in the art.

Examples of polyglycols useful in the practice of this invention include polyethylene glycol with an average molecular weight of about 400, polyethylene glycol with an average molecular weight of about 1000 and polypropylene glycol with an average molecular weight of about 2000. It is preferred to use a polyethylene glycol with an average molecular weight of about 1000 and polypropylene glycol with an average molecular weight of about 2000. It is more preferred to use polypropylene glycol with an average molecular weight of about 2000.

The acid pickling composition of this invention consists essentially of a mixture of the polyalkylene polyamines and polyglycols described above, water and hydrochloric acid. The polyalkylene polyamine is preferably present in a weight percent based on the total amount of polyalkylene polyamine and polyglycol present of at least about 65 percent and no greater than about 95 percent. It is more preferred that the polyalkylene polyamine constitute at least about 70 weight percent and no more than about 80 weight percent based on the total amount of polyalkylene polyamine and polyglycol present. It is most preferred that the polyalkylene polyamine constitute about 75 weight percent based on the total amount of polyalkylene polyamine and polyglycol present. It is preferred that the polyglycol be present in a weight percent based on the total amount of polyalkylene polyamine and polyglycol present of at least about 5 percent and no greater than about 35 percent. It is more preferred that the polyglycol constitute at least about 20 weight percent and no more than about 30 weight percent based on the total amount of polyalkylene polyamine and polyglycol present. It is most preferred that the polyglycol constitute about 25 weight percent based on the total amount of polyalkylene polyamine and polyglycol present.

In a preferred embodiment, the acid pickling composition contains from about 0.3 to 0.5 weight percent of the mixture of polyalkylene polyamine and polyglycol, from about 30 to about 35 weight percent hydrochloric acid, and the remainder water. It is more preferred that the composition comprise about 0.4 percent of the mixture of polyalkylene polyamine and polyglycol, about 35 weight percent hydrochloric acid, and the remainder water. The composition is prepared by adding the appropriate amounts of polyalkylene polyamine and polyglycol to hydrochloric acid of the desired concentration. The composition is shipped to the steel mill where it is diluted to the desired concentration for use in steel pickling applications.

The present invention is also a process comprising the pickling of steel wherein the acid pickling composition described above is used to decrease the amount of iron lost to corrosion during the acoid pickling process. The particular acid pickling process used is not crucial to the practice of the invention so long as the use of the acid pickling composition of this invention results in a decrease in the amount of iron lost to corrosion. The decrease in the amount of iron lost to corrosion will vary depending on various factors including the time the steel is in contact with the pickling solution, the temperature at which the contact is made, the amount of inhibitor and the concentration of the acid in the pickling solution. It is preferred that the decrease in the amount of iron lost to corrosion when the acid pickling composition of this invention is used as compared to when a composition containing no inhibitor is used is at least about 90 percent. It is more preferred that it is about 98 percent and most preferred that it is at least about 99 percent. The decrease in the amount of iron lost to corrosion is determined by subtracting the weight lost when the inhibitor is used from the weight lost when no inhibitor is used and dividing this by the weight lost when no inhibitor is used and multiplying by 100.

As discussed above, the acid pickling composition of this invention is typically shipped to the steel mill in concentrated form and diluted to the desired concentration for use as the acid pickling bath. In a preferred embodiment, the concentration of the acid in the pickling composition when it is diluted for use as the acid pickling bath is at least about one weight percent and no greater than about 20 weight percent. It is more preferred that the concentration of the acid is about 10 weight percent. The concentration of the polyalkylene polyamine/polyglycol mixture in the diluted acid pickling composition used as the acid pickling bath is preferred to be between about 0.05 and 0.5 weight percent and the more preferred concentration will vary depending on what acid concentration is used. When the concentration of acid in the diluted pickling composition is about 10 weight percent, it is preferred that the concentration of the polyalkylene polyamine/polyglycol mixture is about 0.1 weight percent.

The surface characteristics of the acid pickling solution are generally not affected to any great extent by the presence of the polyalkylene polyamine/polyglycol mixture due to the low percentage of the polyalkylene polyamine/polyglycol mixture present in the inhibitor composition.

The acid pickling composition of this invention is useful in pickling processes conducted at any temperature so long as the inhibitor reduces the amount of iron lost to corrosion. It is preferred that the pickling process be conducted at temperatures ranging from at least about room temperature up to about 200° F. (93° C.). The pressure at which the pickling process is conducted is not critical although atmospheric pressure is preferred for the sake of convenience. It is most preferred that both the temperature and pressure used are those which would be used in the steel pickling process in the absence of the use of the acid pickling composition of this invention.

In a preferred embodiment, sheet steel approximately 6 feet wide is linearly fed into four vats about 70 to 100 feet in length which are connected in a series. The steel is contacted counter-currently with hydrochloric acid. The acid pickling composition of this invention, diluted so that hydrochloric acid is present in a concentration of about 10 percent and the inhibiting mixture of polyglycol and polyalkylene polyamine is present in a concentration of about 0.1, is fed in at the fourth vat. Hydrochloric acid containing dissolved ferric chloride and about 0.1 to about 0.3 percent hydrochloric acid is withdrawn from the first vat. The first vat is considered to be the one which the steel sheet contacts first and the fourth vat is the vat which the steel contacts last. Thus the steel is first contacted with a solution having a relatively low acid concentration and in subsequent vats, the concentration of acid gradually increases. The temperature in the first two vats is about 200° F. (93° C.) and drops to about 170° F. (77° C.) in the fourth vat. The steel is immersed in the various vats only a short time. Generally, a particular point on the steel sheet will have passed through all of the vats in a time period of about 1 to 3 minutes. The amount of iron lost to corrosion in this process is about 98 weight percent less than the amount lost in a process differing only in the use of an acid pickling composition which contains no amine/-polyglycol mixture.

The following examples are given to further illustrate the invention and are not to be interpreted as limiting it in any way. Unless stated otherwise, all parts and percentages are by weight.

Experimental Procedure

The effect of various inhibitor compositions is measured by using low carbon steel (less than 0.3 carbon) coupons measuring 0.5 inches by 3 inches. These coupons are immersed in 250-ml flasks containing specified amounts of HCl and specified inhibitors at room temperature. The time each coupon remains in the flask is also varied. After the specified time passes, the coupon is taken out of the flask, dried and weighed. The amount of weight loss and the percentage of weight loss are calculated for each run.

Examples 1 and 2 and Comparative Examples 1–8

The experimental procedure described above is followed in each of the examples and the results obtained are shown in the Table below.

TABLE

| No. | % Acid Conc | Inhibitor & % Conc | Time (hr) | Weight of Sheet (g) | % Weight Lost |
|---|---|---|---|---|---|
| 1 | 10 | 0.075 TEPA | 0 | 4.0818 | — |
| | | 0.025 PG | 48 | 3.9731 | 2.66 |
| | | 2000 | 96 | 3.8703 | 5.18 |
| | | | 168 | 3.7141 | 9.01 |
| 2 | 10 | 0.08 TEPA | 0 | 3.8604 | — |
| | | 0.02 PG | 48 | 3.7477 | 2.92 |
| | | 2000 | 96 | 3.6385 | 5.75 |
| | | | 168 | 3.4766 | 9.94 |
| C-1 | 10 | 0.1 TEPA | 0 | 2.9096 | 0 |
| | | | 72 | 2.7696 | 4.81 |
| | | | 120 | 2.6795 | 7.91 |
| | | | 168 | 2.5884 | 11.04 |
| C-2 | 10 | 0.1 PG | 0 | 2.3704 | — |
| | | 2000 | 48 | 2.2776 | 3.91 |
| | | | 96 | 2.1877 | 7.71 |
| | | | 168 | 2.0306 | 14.33 |
| C-3 | 10 | 0.05 PG | 48 | 2.4759 | 3.15 |
| | | 2000 | 96 | 2.3985 | 6.18 |
| | | | 168 | 2.2628 | 11.48 |
| C-4 | 10 | 0.025 TEPA | 0 | 4.0643 | — |
| | | 0.075 PG | 48 | 3.9327 | 3.24 |
| | | 2000 | 96 | 3.8045 | 6.39 |
| | | | 168 | 3.6014 | 11.39 |
| C-5 | 10 | 0.06 TEPA | 0 | 4.2744 | — |
| | | 0.04 PG | 48 | 4.1481 | 2.95 |
| | | 2000 | 96 | 4.0198 | 5.96 |
| | | | 168 | 3.8149 | 10.75 |
| C-6 | 10 | 0.04 TEPA | 0 | 4.0132 | — |
| | | 0.06 PG | 48 | 3.8918 | 3.03 |
| | | 2000 | 96 | 3.7775 | 5.87 |
| | | | 168 | 3.6059 | 10.15 |
| C-7 | 10 | 0.02 TEPA | 0 | 4.4493 | — |
| | | 0.08 PG | 48 | 4.3184 | 2.94 |
| | | 2000 | 96 | 4.1953 | 5.71 |
| | | | 168 | 3.9963 | 10.18 |
| C-8 | none | | 0 | 3.8470 | — |
| | | | 42 | 3.0968 | 19.50 |
| | | | 114 | 2.0065 | 52.16 |
| | | | 162 | 1.4861 | 61.84 |

TEPA = tetraethylene pentamine
PG = polypropylene glycol

The effectiveness of acid pickling compositions containing the claimed mixture of TEPA and polyglycol as corrosion inhibitor under laboratory conditions is shown in the table. When the steel coupons are left in the acid pickling bath for a week, the loss of steel to corrosion ranges from 9.01 percent to 9.94 percent when the acid pickling composition of this invention is used. Comparative examples C-1 and C-2 demonstrate that TEPA and polypropylene glycol are effective alone as corrosion inhibitors. However, when compared to Examples 1 and 2, it is clear that their combination in the proper ratios results in a surprisingly improved corrosion inhibitor. Comparative examples C-3 through C-7 demonstrate that the proper proportions of polyalkylene polyamine to polyglycol results in a surprisingly effective inhibitor. Comparative example C-8, where no inhibitor is used, demonstrates clearly the need for the use of inhibitors in steel pickling processes.

What is claimed is:

1. A pickling composition, useful in the inhibition of the corrosion of iron-containing metals, consisting essentially of hydrochloric acid, water and a mixture containing from about 0.05 to about 0.5 percent of the composition of a mixture of about 65 to about 95 weight percent of at least one polyalkylene polyamine based on the weight of polyalkylene polyamine and polyglycol and from about 5 to about 35 weight percent of at least one polyglycol based on the weight of polyalkylene polyamine and polyglycol wherein the polyalkylene polyamine corresponds to the formula $$H_2N—(R—NH)_n—R—NH_2$$

wherein R may be ethylene or propylene and n is a number from 1 to about 165 such that the molecular weight of the polyalkylene polyamine is at least about 100 and is no greater than about 5000.

2. The composition of claim 1 wherein the weight percent of the polyalkylene polyamine is at least about 70 and no greater than about 80.

3. The composition of claim 2 wherein the weight percent of polyalkylene polyamine is about 75.

4. The composition of claim 1 wherein the molecular weight of the polyalkylene polyamine is no greater than about 3000.

5. The composition of claim 4 wherein the polyalkylene polyamine is tetraethylene pentamine.

6. The composition of claim 1 wherein the polyglycol is polypropylene glycol with an average molecular weight between about 400 and about 5000.

7. The composition of claim 6 wherein the polyglycol is polypropylene glycol with an average molecular weight of about 2000.

8. The composition of claim 1 wherein the mixture of polyalkylene polyamine and polyglycol forms from about 0.3 to about 0.5 weight percent of the composition, hydrochloric acid forms from about 30 to about 35 weight percent of the composition, and water forms the remainder of the composition.

9. The composition of claim 8 wherein the mixture of polyalkylene polyamine and polyglycol forms about 0.4 weight percent of the composition, hydrochloric acid forms about 35 weight percent of the composition, and water forms the remainder of the composition.

10. A process for the inhibition of corrosion of iron-containing metals during acid pickling comprising the use of the acid pickling composition of claim 1 in the acid pickling bath.

11. The process of claim 10 wherein the concentration of the mixture of polyalkylene polyamine and polyglycol in the acid pickling bath is at least about 0.05 and no greater than about 0.5 weight percent.

12. The process of claim 11 wherein the concentration of the mixture of polyalkylene polyamine and polyglycol in the acid pickling bath is about 0.1 weight percent.

13. The process of claim 10 wherein the concentration of hydrochloric acid in the acid pickling bath is at least about 1 weight percent and no greater than about 20 weight percent.

14. The process of claim 13 wherein the concentration of hydrochloric acid in the acid pickling bath is about 10 weight percent.

15. The process of claim 10 wherein the temperature is between room temperature and about 93° C.

16. The process of claim 10 wherein the corrosion of the iron-containing metal is inhibited by at least about 98 weight percent.

17. The process of claim 16 wherein the corrosion of the iron-containing metal is inhibited by at least about 99 weight percent.

* * * * *